United States Patent [19]

Ito et al.

[11] Patent Number: 4,927,338

[45] Date of Patent: May 22, 1990

[54] RADIAL PISTON PUMP

[75] Inventors: Yoshiaki Ito, Kariya; Kougi Nagai, Anjo; Akihiko Sawada, Toyohashi; Hideyuki Koike, Nagoya, all of Japan

[73] Assignee: Nippondenso Co., Ltd., Kariya, Japan

[21] Appl. No.: 162,205

[22] Filed: Feb. 29, 1988

[30] Foreign Application Priority Data

Mar. 2, 1987 [JP] Japan ..... 62-47194
Dec. 25, 1987 [JP] Japan ..... 62-331338

[51] Int. Cl.[5] ..... F04B 1/04
[52] U.S. Cl. ..... 417/462; 91/497
[58] Field of Search ..... 417/462; 91/497, 498

[56] References Cited

U.S. PATENT DOCUMENTS 3,188,918 6/1965 Bjorklund ..... 91/497
3,345,916 10/1968 Tobias ..... 91/497
3,374,712 3/1968 Bjorklund ..... 91/497
3,874,271 4/1975 Eickmann .
4,555,223 11/1985 Budecker et al. .
4,605,359 8/1986 Suzuki ..... 417/270
4,627,793 12/1986 Kuroyanagi ..... 417/271
4,652,215 3/1987 Kuroyanagi et al. .
4,776,768 10/1988 Kondoh ..... 417/273

FOREIGN PATENT DOCUMENTS 48604 4/1986 Japan ..... 417/273
48606 6/1986 Japan ..... 91/498
48607 7/1986 Japan ..... 91/498
2163493 2/1986 United Kingdom .

*Primary Examiner*—Leonard E. Smith
*Assistant Examiner*—Eugene L. Szczecina, Jr.
*Attorney, Agent, or Firm*—Cushman, Darby & Cushman

[57] ABSTRACT

A radial piston pump for the automotive brake system has a rotor, a couple of pistons reciprocated within a respective cylinder formed within the rotor and a bearing. The top end of the piston abuts directly to the inner surface so that no show is existed therebetween. The relationship within a starting point and a finishing point of a suction groove, a starting point and a finishing point of a disharge groove and an opening port the cylinder is designed in such a manner that at least one of a couple of cylinders connects to the suction groove during a whole rotation of the rotor.

17 Claims, 7 Drawing Sheets

RADIAL PISTON PUMP

FIELD OF THE INVENTION

The present invention relates to an radial piston pump having an usage of an oil pump for discharging high pressurized oil toward an automotive brake system.

BACKGROUND OF THE INVENTION

A radial piston pump having a pump shaft rotatably provided within a housing, a rotor connected with the pump shaft, and a piston reciprocally provided within a cylinder formed in the rotor in such a manner that the piston is reciprocated in accordance with the rotation of the rotor has been known (U.S. Pat. No. 3,756,479). Since the top end of the piston of such conventional type of radial piston pump abuts toward an inner surface of an inner race and since the top end of the piston slides along with the inner surface of the inner race, the conventional type of radial piston pump has such disadvantages that the top portion of the piston and the inner surface of the inner race wear and an eccentric noise may generate within the pump portion.

In order to solve these disadvantages, the radial piston pump employs a shoe between the top end of the piston and the inner surface of the bearing inner race (U.S. Pat. No. 3,872,271). The shoe is used for reducing the abrasion. The shoe, however, caused the disadvantage that the shoe increases the production cost and the shoe requires another assembling step. Furthermore, since the shoe also requires the limiting mechanism for protecting the shoe from dropping off the rotor, the radial piston pump employing the shoe is a complex structure.

A ball is employed at the top end of the piston in order to reduce the abrasion of the top end of the piston and the inner surface of the inner race (U.S. Pat. No. 4,555,223). Since the inner diameter of the ball should be smaller than the inner diameter of the piston, the stress on the abutting area where the ball contacts with the inner race is great. Thus, the ball cannot to use for a long period of time. Furthermore, since the piston is not biased toward the ball, the ball may become spaced from the piston for example, when the temperature of the working fluid is cold and viscosity of the working fluid is high. The pump cannot work effectively when the ball aparts from the piston.

SUMMARY OF THE INVENTION

The present invention has an object of protecting abrasion at the contacting point of the top end of the piston and the inner surface of the inner race. Another object of the present invention is to provide radial piston pump having a piston the top end of which directly abuts to the inner surface of the inner race.

In order to attain the above objects, the present stroke employs a piston slidably provided within the cylinder formed in the rotor. The piston of the present invention is so designed that both of a couple of pistons do not received discharge pressure simultaneously. In other words, a couple of working chamber defined by a couple of pistons do not simultaneously effect a discharge stroke.

The relationship within a starting point and finishing point of a discharge groove, a starting point and finishing point of a suction groove and a pump column is designed as described below. The finishing point of the discharge groove fits to a rear end portion of an opening end of the cylinder when the piston reaches the bottom dead point, namely when the distance between the outer surface of the rotor and the inner surface of the bearing becomes a minimum. A first predetermined angle $\theta_1$ is formed between the starting point of the suction groove and the front end point of the opening end of the cylinder at that time. When the rotor rotates by the first predetermined angle $\theta_1$ from the above described position, there exists a second predetermined angle $\theta_2$ between the finishing point of the suction groove and the rear end point of the opening of the another cylinder. After the rotor rotates by the second predetermined angle $\theta_2$ from this position, there exists a third predetermined angle $\theta_3$ between the starting point of the discharge groove and the front end point of the opening of the another cylinder. The distance between the finishing point of the suction groove and the starting point of the discharge groove and the distance between the finishing point of the discharge groove and the starting point the suction groove are so designed that both distances are longer than the inner diameter of the opening point of the cylinder.

Since the radial piston pump of the present invention employs the features described above, only a single piston is biased against the inner race by a high pressure and the slip between the top end of the piston and the inner surface of the inner race caused by a friction of the another piston does not occur. Accordingly, the inner race of the present invention receives a rotating force through only a single piston, so that the inner race can rotate simultaneously with the rotor. Accordingly, a relative movement between the inner race and the piston of the present invention is only a wobbling movement, and the piston does not slip along with a tangent direction so that the friction at the top end of the piston is reduced and the shoe such as that used in the conventional type radial piston pump can be omitted.

Furthermore, since the top end of the piston of the present invention is spherical, and since the sectional shape of the inner race of the present invention is also spherical, the contacting stress between the top end of the piston and the inner surface of the inner race can be reduced.

DETAIL DESCRIPTION OF PREFERRED EMBODIMENT

Figure 1:
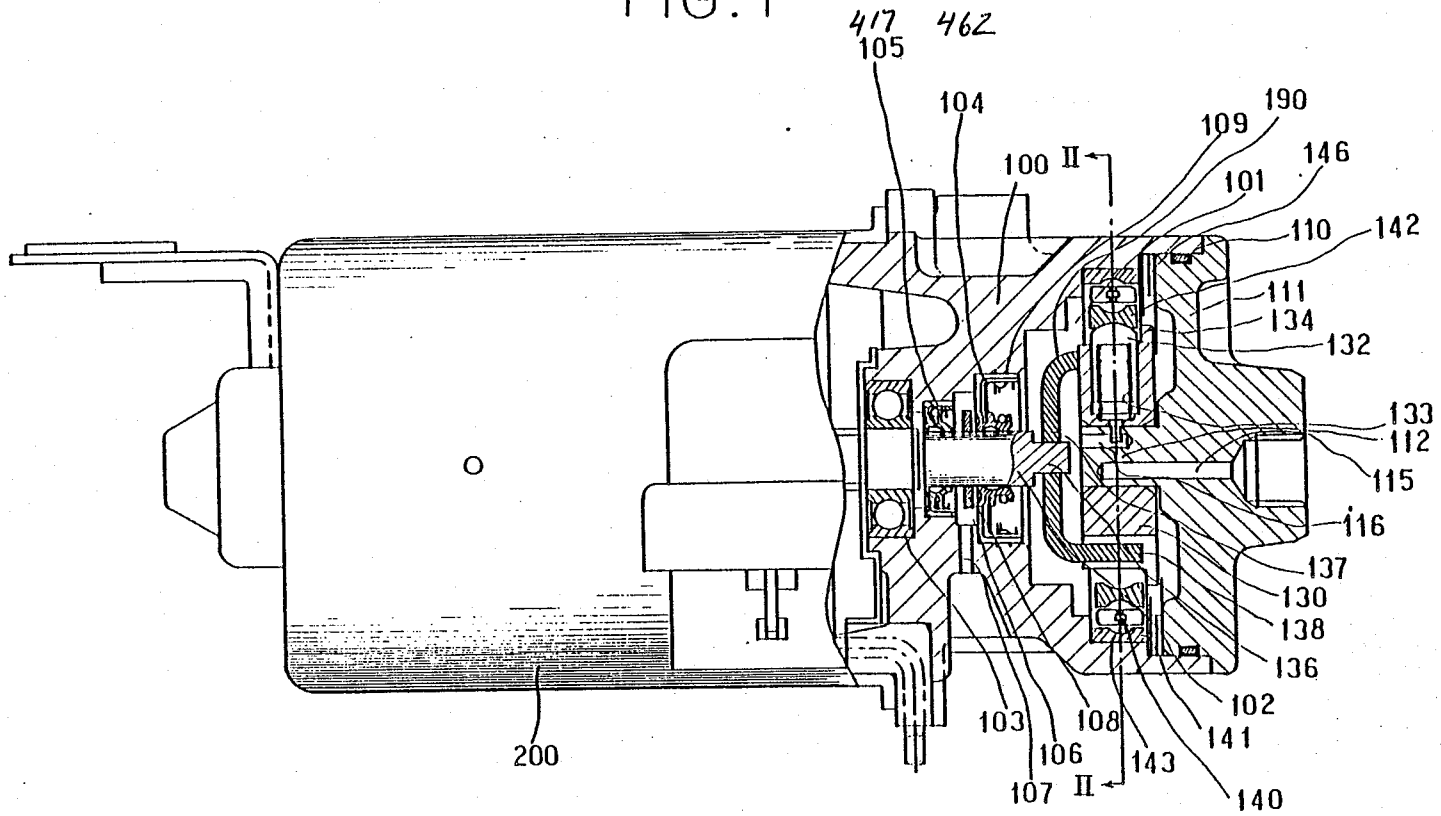
FIG. 1 is a sectional view showing an embodiment of the present invention.

The reference numeral 100 in FIG. 1 designates pump housing, a suction chamber 101 is formed within the housing 100. A shaft 102 is also provided within the housing 100 in such a manner that the shaft 102 is rotatably supported by a bearing 103. The shaft 102 is connected with the rotating shaft of a motor 200. The rotating shaft of the motor 200 is also supported by the bearing (not shown).

A first oil seal 104 and a second oil seal 105 are provided within the housing 100 for protecting the leakage of the working fluid within the housing 100 along with the shaft 102. A seal chamber 106 are formed between the first oil seal 104 and the second oil seal. The seal chamber 106 is connected to the outer atmosphere through a connecting hole 107 for keeping the pressure within the seal chamber constant. Since the connecting hole 107 is formed at the bottom portion of the housing 100, the leaked oil within the seal chamber 106 can drain.

A centrifugal ring 108 is fixed to the shaft 102 at the position within the seal chamber 106, so that the leaked oil passing along with the shaft 102 is diffused toward the connecting port 107 by the centrifugal force caused by the ring 108.

Since the first oil seal 104 is provided between the seal chamber the pressure therein is atmospheric pressure and a suction chamber 101 the working fluid is contained therein, the first oil seal 104 is required to have an effective sealing faculty. The first oil seal 104 is fixed within the holding groove 109 which is formed within the housing 100.

An end plate 111 is connected to the housing 100 via an O-ring 110, and a pump column 112 is formed on the end plate 111 in such a manner that the pump column 112 faces to the shaft 102. The pump column 112 as well as the shaft 102 off-sets from the rotating center of the bearing 140 provided within the suction chamber 111 by a predetermined eccentric amount.

Figure 2:
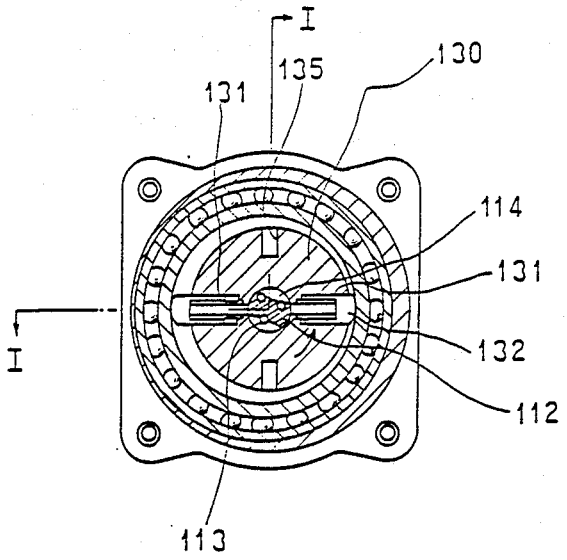
FIG. 2 is a sectional view taken along with I—I line of FIG. 1.
Figure 4:
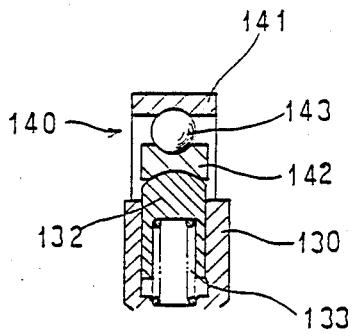
FIG. 4 is a sectional view showing the piston and the bearing shown in FIG. 1, FIGS. 5, 6 and 7 are sectional views explaining the rotating position of the pump shown in FIG. 1.

A discharge groove 113 and a suction groove 114 are formed at the outer surface of cylindrical pump column 112 as shown in FIG. 2. The discharge groove 113 is formed at one surface of the column 112 and the suction groove 114 is formed at another surface of the column 112. The opening angle of the discharge groove 113 should be less than 180 degree, the opening angle of the discharge groove 113 of the present embodiment is about 140 degree. The opening angle of the suction groove 114 also should be less than 180 degree, and that of the present embodiment is about 140 degree.

The discharge groove 113 is connected with a discharge path 115 which is formed within the pump column 112 and the end plate 111, so that high pressurized working oil is discharged toward an automotive brake system via the discharge path 115. The suction groove 114 is connected with the suction chamber 111 via a suction path 116 which is formed within the pump column 112. Since the suction chamber 101 is connected with an oil sump via a suction port which is not shown, the working oil within the oil sump is supplied to the suction groove through the suction path 116.

A cylindrical rotor 113 is provided around the pump column 112 by a predetermined small clearance. A couple of cylinders 131 are formed within the rotor 130 as shown in FIG. 2 in such a manner that both of a couple of cylinders are spaced from each other by 180 degrees. A piston 132 is slidably provided within the cylinder 131 by keeping slight clearance between the inner surface of the cylinder 131 and the outer surface of the piston 132. A spring 133 is provided within the cylinder 131 for biasing the piston 132 outwordly.

Figure 5:
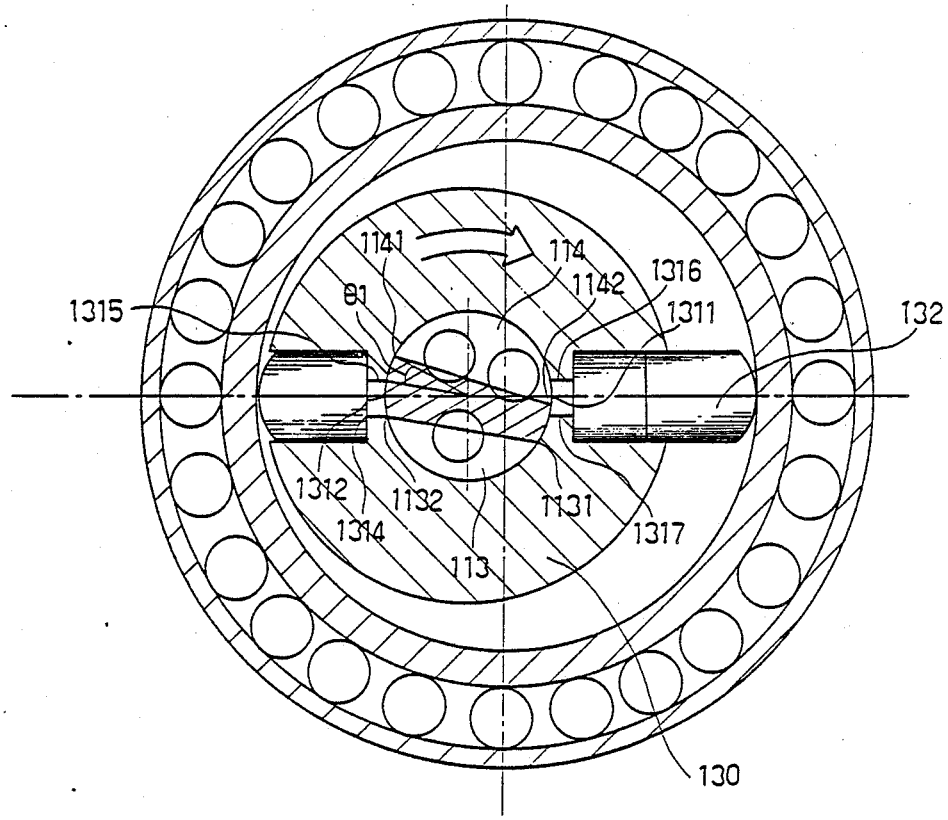

The relationship between the starting point 1141 and the finishing point 1142 of the suction groove, the starting point 1131 and the finishing point 1132 of the discharge groove 113 and opening ports 1311 and 1312 of each of the cylinders 131 are so designed that described hereinafter. FIG. 5 shows the first position when the first piston 132 becomes a bottom dead point, namely when the distance between the outer surface of the rotor 130 and the inner surface of the inner race 142 becomes minimize. At this position, the rear side end point 1314 of the opening port 1312 of the first cylinder 131 fits to the finishing point 1132 of the discharge groove 113, and there exits a first predetermined angle $\theta_1$ between the opening point 1141 of the suction groove 114 and the front end point of the opening port of the first cylinder 131. The inner diameter of the opening port 1312 of the present embodiment is about 3 mm and the first predetermined angle $\theta_1$ of the present embodiment is about 15 degree.

Figure 6:
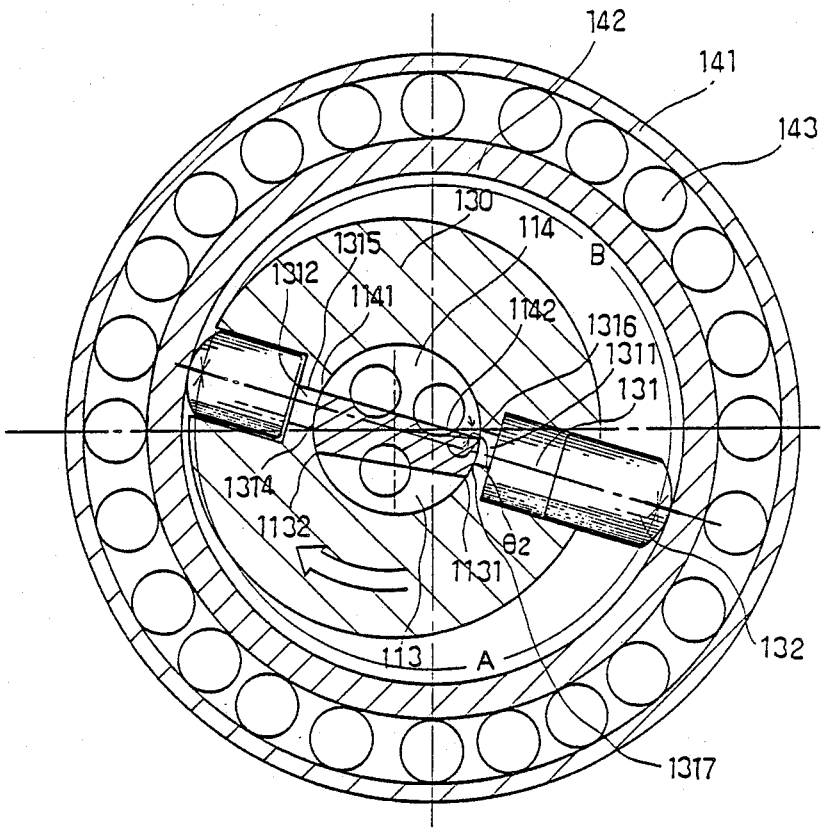

FIG. 6 shows second position where the rotor 130 rotates by the first predetermined angle $\theta_1$ from the first position. At the second position, the front end point 1315 of the opening port 1312 fits to the starting point 1141 of the suction groove 114, and there exists a second predetermined angle $\theta_2$ between rear end point 1316 of the opening port 1311 of the second cylinder 131 and the finishing point 1142 of the suction groove 114 as shown in FIG. 6. Accordingly, the opening port 1311 of the second cylinder 131 is connected to the suction groove 114 via the second predetermined angle $\theta_2$. The second predetermined angle $\theta_2$ of the present embodiment is about 5 degree.

Figure 7:
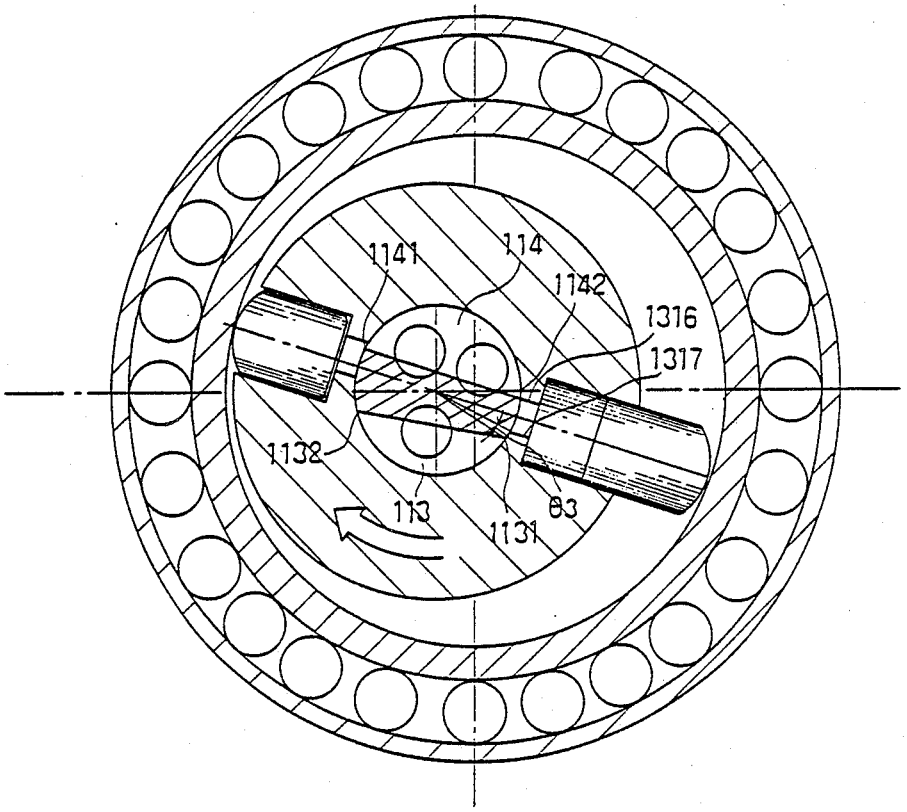

FIG. 7 shows the third position where the rotor 130 rotates by the second predetermined angle $\theta_2$ from the second position. At this third position, the finishing point of the suction groove 114 fits to the rear end point 1316 of the opening port 1311, and there exists a third predetermined angle $\theta_3$ between the front end point 1317 of the opening port 1311 and the starting point 1131 of the discharge groove 113 as shown in FIG. 7. The third predetermined of the present embodiment is about 15 degree.

The distances between the finishing point 1132 of the discharge groove 113 and the starting point 1141 of the suction groove 114 and the finishing point 1142 of the suction groove 114 and the starting point 1131 of the discharge groove 113 are longer than the inner diameter of the opening ports 1311 and 1312 of the cylinders in order to attain the effective seals at the opening port 1311 and 1312 of the cylinders. A seal length of the first predetermined angle $\theta_1$ is formed at the opening port 1412, and a seal length of the third predetermined angle $\theta_3$ is formed at the another opening port 1311.

Even though the first predetermined angle $\theta_1$ and the third predetermined angle $\theta_3$ are very important for keeping the seal around the opening ports 1312 and 1311, the predetermined angles $\theta_1$ and $\theta_3$ further have the important operation for modulating the pressure of the working fluid within the cylinder 131.

The cylinder 132 is under discharge stroke until the opening port 1312 departs from the discharge groove as shown in FIG. 5, and the pressure of the working fluid within the cylinder under the discharge stroke is held around 100–200 atm. If the opening port 1312 connects to the starting point 1141 of the suction groove just after the end of the discharge stroke, the pressure of the working fluid within the cylinder reduces suddenly from the discharge pressure (100–200 atm) to the suction pressure (1 atm), and such rapid pressure change causes an extraordinary noise and also causes the pump to vibrate.

The present pump, on the other hand, has the first predetermined angle between the opening port 1312 and the starting point 1141 of the suction groove, the piston 132 moves outwordly while the rotor rotates by the first predetermined angle $\theta_1$, so that the pressure within the cylinder 131 can reduce. In other words, the pressure within the cylinder 131 can already reduced to about the suction pressure when the opening port 1312 connects to the starting point 1141 of the suction groove 114. The pump of the present embodiment does not have the sudden pressure change around the starting point 1141 of the suction groove, so that the pump of the present embodiment does not vibrate.

The opening port 1311 of the cylinder 131 still connects to the suction groove 114 even after the upper dead point of the piston 132 as shown in FIG. 5 for keeping the pressure within the cylinder 131 under suction pressure for a long while. The opening port 1311 passes through the finishing point 1142 of the suction groove 114 at the third position shown in FIG. 7. Since the third predetermined angle $\theta_3$ exists between the opening port 1311 and the starting point 1131 of the discharge groove 113, the working fluid within the cylinder 131 is preliminary pressurized. This preliminary pressurizing makes the pressure of the working fluid within the cylinder 131 increases from the suction pressure (1 atm) to the high pressure which is closed the discharge pressure. Thus, a rapid pressure change does not occur at the point when the opening port 1311 of the cylinder 131 connects to the starting point 1131 of the discharge groove 113.

Figure 8:
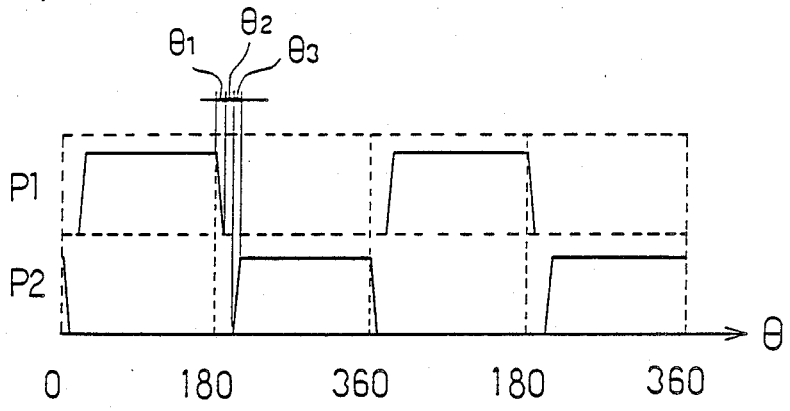
FIG. 8 shows the variation of the pressure within the cylinder in accordance with the rotation.

FIG. 8 shows the pressure change within the cylinders 131 in accordance with the rotational angle of the rotor 130. The 0 degree of the rotational angle represents the bottom dead point of the piston 132. As clearly understood from FIG. 8, the pressure within the cylinder 131 gradually increases while the third predetermined angle $\theta_3$, and gradually reduces while the first predetermined angle $\theta_1$. Both first and second cylinders 131 stay the suction pressure simultaneously by the second predetermined angle $\theta_2$.

Figure 3:
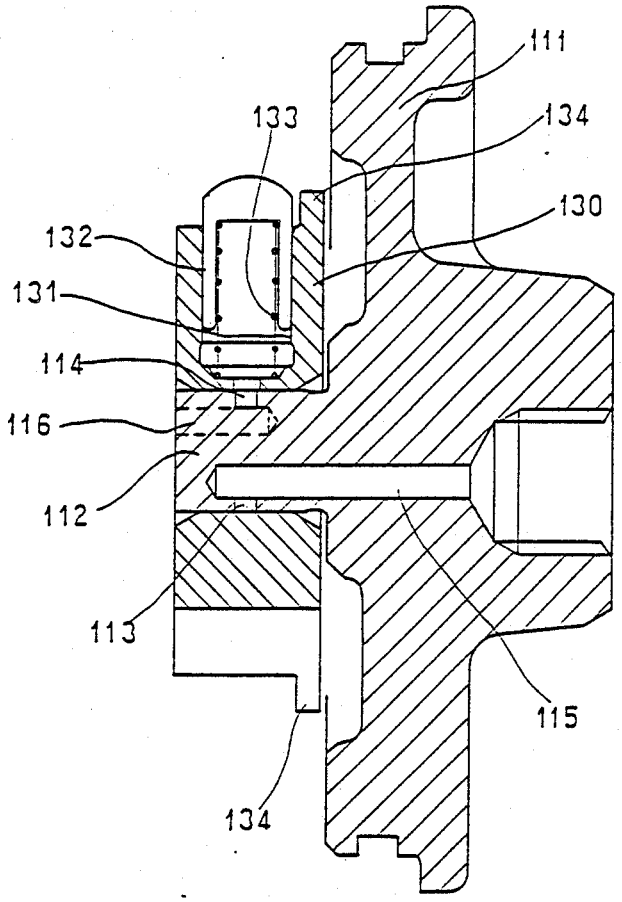
FIG. 3 is a sectional view showing the end plate and the rotor shown in FIG. 1.

As shown from FIGS. 1 and 3, the top end of the piston 132 is shaped to be spherical. A limiting piece 134 is formed on the outer surface of the rotor 130 on the end plate 111 side. A couple of connecting grooves 135 are formed on the outer surface of the rotor 130 on the shaft 102 side. Each of the connecting grooves 135 is spaced from the cylinder 131 by 90 degrees.

A coupling 137 is connected to a flat surface 136 formed on the end portion of the shaft 102 so that the coupling 137 rotates synchronizedly with the shaft 102. The coupling has a couple of connecting pieces each of which is inserted into the connecting groove 135 of the rotor 130, so that the rotation of the shaft 102 is transmitted to the rotor 130 through the coupling 137. Since the connecting piece 138 is bent perpendicularly from the coupling 137, the connecting piece 138 can limit the horizontal movement of the rotor along with the axis of the pump column 112, so that the rotor 130 is well prevented to be dropped off the pump column 112.

A bearing 140 is provided within the suction chamber 101 in such a manner that the inner surface of the bearing 140 faces to the outer surface of the rotor 130. The bearing 140 has an outer race 141 which abuts to the housing 100, an inner race 141 to which the top end of the piston 132 abuts, and a number of balls 143 provided between the inner race 142 and the outer race 141. The sectional shape of the inner race 142 is formed to be spherical in order to fit with the top end of the piston 132. Accordingly, the top end of the piston 132 can contact with the inner race 142 via an enough wide area, so that the stress caused between the top end of the piston 132 and the inner race 142 can be reduced.

Since the limiting piece 134 formed on the rotor 130 faces to the side surface of the inner race 142, the inner race 142 can rotate synchronizedly with the rotor 130 when the limiting pieces 134 contacts to the inner race 142, so that the relative movement between the top end of the piston 132 and the inner surface of the inner race 142 is well prevented. Furthermore, since the limiting piece 134 can contact with the inner race 142 when the rotor 130 slides along with the axis of the shaft, the rotor 130 is well prevented from dropping off the pump column 112.

A leaf spring 146 is provided between the end plate 111 and the outer race 141 for holding the outer race 141. The width of the inner race 142 is narrower than that of the outer race 141, so that the working oil within the chamber can be introduced into the intermediate portion where a number of balls 143 are held. Furthermore, since the width of the inner race 142 is smaller than that of the outer race, the inner race 142 can rotate more effectively.

The operation of the above described pump is explained hereinafter.

The shaft 102 starts to rotate within the housing 100 when the motor 200 starts to rotate. The rotation of the shaft 102, then, is transmitted to the rotor 130 via the coupling 137, so that the rotor 130 starts to rotate on the pump column 112. Since the pump column 112 off-sets from the center axis of the bearing 140, the distance between the pump column 112 and the inner race 142 varies in accordance with the rotation of the rotor 130, so that the piston 132 reciprocates within the cylinder 131. During the suction stroke, namely while the cylinder 131 functionally connects to the suction groove 114, the working fluid within the suction groove 114 is sucked toward the cylinder 131. The piston 132 moves outwordly by the biasing force of spring 133 and the centrifugal force caused by the rotation of the rotor 130, so that the top end of the piston 132 is forced toward the inner surface of the inner race 142. However, the stress caused between the top end of the piston 132 and the inner surface of the inner race 142 during the suction stroke is much smaller than that during the discharge stroke. The stress during the suction stroke of the present embodiment is about 1 Kg.

During the discharge stroke, the cylinder 131 functionally connects to the discharge groove 113. The piston 132 is forced to be moved into the cylinder 131, so that the working fluid within the cylinder 131 is discharged toward the discharge groove 113. Since the pressure of the working fluid within the cylinder 131 increases, the piston 132 is biased toward the inner race 142 by extremely high pressure. The stress caused between the top end of the piston 132 and the inner surface of the inner race 142 during the discharge stroke of the present embodiment is about 100 Kg.

Since the central axis of the rotor 130 is off set from the center axis of the bearing 140, the piston 132 relatively wobbles with the inner race 142, and the distance between a couple of pistons 132 along with the inner surface of the bearing 142 (designated by the reference letter A and B in FIG. 6) is valid in accordance with the rotation of the rotor 132. It should be noted that a couple of pistons 132 of the present invention do not receive the discharge pressure simultaneously. Accordingly, at least one of a couple of pistons 132 receives the suction pressure. The inner race 142 rotates synchronizedly with the rotation of the piston 132 by which the discharge pressure is caused, so that there should be generated the relative movement between the inner surface of the inner race 142 and the top end of the piston 132 to which suction pressure is applied. However, since the stress caused between the inner race 142 and the piston to which the suction pressure is applied is small enough, no abrasion is occurred between the inner race 142 and the piston 132 to which the suction pressure is applied.

Figure 9:
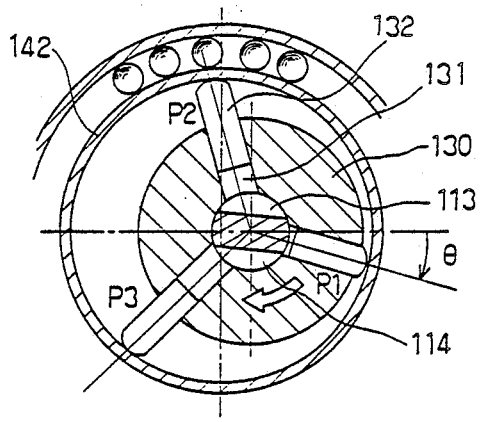
FIG. 9 is a sectional view of the radial piston pump having three pistons, FIG. 10 explains the variation of the pressure within the cylinder of the pump shown in FIG. 9.
Figure 10:
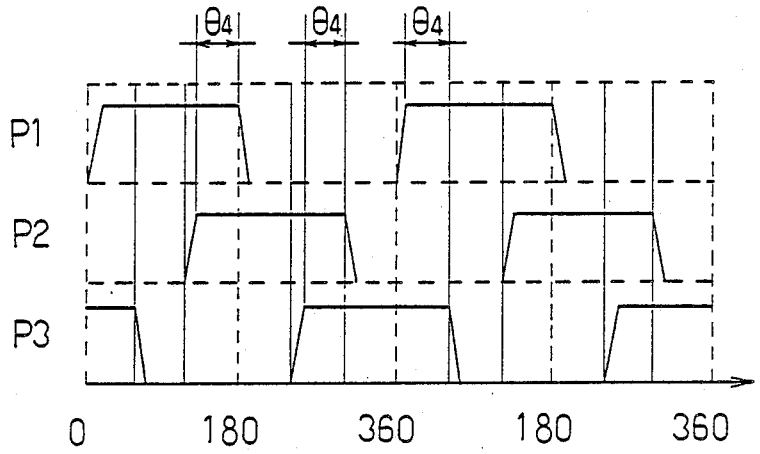

In order to explain the effect of the present invention more clearly, the operation of the present embodiment is explained hereinafter in comparison with the pump having three pistons 132 as shown in FIG. 9. Since the volume of three cylinders 131 are varied in accordance with the rotation of the rotor 130 simultaneously, the pressure within the cylinder 131 are also varied in accordance with the rotation of the rotor 130 as shown in FIG. 10.

It should be noted the radial piston pump having three pistons 132 should have the condition when two of three cylinders are applied by the discharge pressure, accordingly two pistons are forced toward the inner race 142 by high pressure simultaneously. Since the distance between an adjacent two pistons 132 along with the inner surface of the inner race are varied in accordance with the rotation of the rotor 130, the top end of the two pistons to which high pressure is applied should slide against the inner race and should wear. In order to avoid the abrasion, such radial piston pump having three pistons should have shoe between the piston 132 and the inner race 142. The shoe, however, should bring such disadvantage that the shoe increases the producing cost of the pump, as described before.

The radial piston pump of the present invention, on the other hands, can well prevent the abrasion of the piston 132 and the inner race 142 because at least one of a couple of pistons 132 receive the suction pressure at any position during the rotation of the rotor 130.

It should be noted that the above described effort of the present invention cannot be attained by the number of the piston 132. Even the radial piston pump having a couple of pistons, there should exist the condition that both pistons receive discharge pressure, if the opening port 1311 and 1312 of the cylinder, the suction groove 114 and the discharge groove 113 are designed by such conception that the discharge stroke ends at the bottom dead point and the suction stroke ends at the top dead point. The important feature of the present invention to attain the above described effect is that the combination of that the number of the pistons 132 is two and that there exist the condition that both pistons 132 receive the suction pressure simultaneously.

Furthermore, since the top end of the piston 132 of the present embodiment is formed spherically, the stress caused between the top end of the piston 132 and the inner race 142 can reduces for protecting the abrasion.

What is claimed is:

1. Radial piston pump comprising:

a housing having a cylindrical suction chamber therein;

a shaft rotatably provided within said housing, a longitudinal axis of said shaft being off-set from a center axis of said suction chamber by predetermined amount;

a pump column provided within said suction chamber of said housing, a longitudinal axis of said pump column is co-axial with the longitudinal axis of said shaft, said pump column having a suction groove on an outer surface thereof, a suction path connecting said suction groove to said suction chamber, a discharge groove formed on the outer surface thereof and the discharge path connecting said discharge groove to an outside of said pump column;

a rotor rotatably provided on said pump column, said rotor having a first and a second cylinders therein, each of said first and second cylinders aparting from each other by 180 degree;

a first and a second pistons each of which is slidably provided within each of said first and second cylinders;

a bearing provided within said suction chamber of said housing between said housing and said rotor, said bearing having an outer race fixing to said housing and an inner race to which a top end of said piston abuts; and coupling transmitting the rotation of said shaft to said rotor wherein;

wherein the relation within a starting point and a finishing point of said suction groove, a starting point and a finishing point of said discharge groove and opening ports of said first and second cylinders is designed in such a manner that;

a rear end point of said opening port of said first cylinder functionally fits to said finishing point of said discharge groove and there exists a first predetermined angle $\theta_1$ between a front end point of said opening port of said first cylinder and said starting point of said suction groove at a first position when said first piston locats a bottom dead point;

said front end point of said opening port of said first cylinder fits to said starting point of said discharge groove and there exists a second predetermined angle $\theta_2$ between a rear end point of said opening port of said second cylinder and said finishing point of said suction groove at a second position when said rotor rotates by said first predetermined angle $\theta_1$ from said first position;

said rear end point of said opening port of said second cylinder fits to said finishing point of said suction groove and there exists a third predetermined angle $\theta_3$ between a front end point of said opening port of said second cylinder and said starting point of said discharge groove at a third position when said rotor rotates by said second predetermined angle from said second position; and said front end point of said opening port of said second cylinder fits to said starting point of said discharge groove at a position when said rotor rotates by said third predetermined angle $\theta_3$ from said third position.

2. A radial piston pump claimed in claim 1, wherein:

said rotor having a limiting piece at an outer surface thereof on the opposite side of said coupling so that said limiting piece faces to a side surface of said inner race.

3. A radial piston pump claimed in claim 1:

the top end of said piston is formed to be spherical and an sectional shape of said inner race is also shaped to be spherical so that at least certain amount of the top end of said piston contacts to the inner surface of said inner race.

4. A radial piston pump claimed in claim 1, wherein: said first predetermined angle $\theta_1$ is about 15 degree.

5. A radial piston pump claimed in claim 1, wherein: said second predetermined angl $\theta_2$ is about 10°.

6. A radial piston pump claimed in claim 1, wherein: said third predetermined angle $\theta_3$ is about 15°.

7. A radial piston pump claimed in claim 1, wherein: said first predetermined angle $\theta_1$ is wider than said third predetermined angle $\theta_3$.

8. A radial piston pump comprising:

a housing having a cylindrical suction chamber therein;

a shaft rotatably provided within said housing in such a manner that a longitudinal axis of said shaft is off-set from a center axis of said suction chamber;

a pump column provided within said suction chamber of said housing in such a manner that a longitudinal axis of said pump is co-axial with the longitudinal axis of said shaft, said pump column having a suction groove provided on the surface thereof, a suction path connecting said suction groove to said suction chamber, a discharge groove provided on the surface of said pump column and a discharge path connecting said discharge groove to an outside of said pump column;

a rotor rotatably provided on said pump column, said rotor having a first and a second cylinders which apart from each other by 180 degree;

a first and a second pistons slidably provided each of said first and second cylinders;

a bearing provided between said housing and said rotor, said bearing having an outer race fixed to said housing and an inner race to which a top end of said piston abuts; and a coupling means for transmitting the rotation of said shaft to said rotor, wherein;

relationship within a starting point and a finishing point of said suction groove, a starting point and a finishing point of said discharge groove and an opening port of each of said first and second cylinders is designed in such a manner that at least one of said first and second cylinders connects to said suction groove during a whole rotation of said rotor.

9. A radial piston pump claimed in claim 8, wherein: said rotor having a limiting piece at an outer surface thereof on the opposite side of said coupling so that said limiting piece faces to a side surface of said inner race.

10. A radial piston pump claimed in claim 8:

the top end of said piston is formed to be spherical and an sectional shape of said inner race is also shaped to be spherical so that at least certain amount of the top end of said piston contacts to the inner surface of said inner race.

11. A radial piston pump comprising:

a housing having a cylindrical suction chamber therein, a shaft rotatably provided within said housing in such a manner that a longitudinal axis of said shaft is off-set from a center axis of said suction chamber;

a pump column provided within said suction chamber of said housing in such a manner that a longitudinal axis of said pump is co-axial with the longitudinal axis of said shaft, said pump column having a suction groove provided on the surface thereof, a suction path connecting said suction groove to said suction chamber, a discharge groove provided on the surface of said pump column and a discharge path connecting said discharge groove to an outside of said pump column;

a rotor rotatably provided on said pump column, said rotor having a first and a second cylinders which apart from each other by 180 degree;

a first and a second piston slidably provided each of said first and second cylinders;

a bearing provided between said housing and said rotor, said bearing having an outer race fixed to said housing and an inner race to which a top end of said piston abuts; and a coupling means for transmitting the rotation of said shaft to said rotor wherein;

relationship within a starting point and a finishing point of said suction groove, a starting point and finishing point of said discharge groove and opening port of each of said first and second cylinders is designed in such a manner that said opening port of said first cylinder is shut off from both said discharge groove and said suction groove and said opening port of said second cylinder connected with said suction groove at a first position when said first piston locates a bottom dead point and said first piston locates a top dead point;

said opening port of said first cylinder starts to connect with said suction groove and said opening port of said second cylinder connects with said suction groove at a second position when said rotor rotates by a first predetermined angle $\theta_1$;

said opening port of said first cylinder is connected with said suction groove and said opening port of said second cylinder is shut off both said suction groove and said discharge groove at a third position when said rotor rotates by a second predetermined angle $\theta_2$ from said second position; and said opening port of said first piston is connected with said suction groove and said opening port of said second cylinder starts to be connected with said discharge groove at a fourth position when said rotor rotates by a third predetermined angle $\theta_3$ from said third position.

12. A radial piston pump claimed in claim 11, wherein:

said rotor having a limiting piece at an outer surface thereof on the opposite side of said coupling so that said limiting piece faces to a side surface of said inner race.

13. A radial piston pump claimed in claim 11:

the top end of said piston is formed to be spherical and an sectional shape of said inner race is also shaped to be spherical so that at least certain amount of the top end of said piston contacts to the inner surface of said inner race.

14. A radial piston pump claimed in claim 11, wherein:

said first predetermined angle $\theta_1$ is about 15 degree.

15. A radial piston pump claimed in claim 11, wherein:

said second predetermined angle $\theta_2$ is about 10°.

16. A radial piston pump claimed in claim 11, wherein:

said third predetermined angle $\theta_3$ is about 15°.

17. A radial piston pump claimed in claim 11, wherein:

said first predetermined angle $\theta_1$ is wider than said third predetermined angle $\theta_3$.

* * * * *